United States Patent [19]

Brewerton

[11] Patent Number: 4,841,895

[45] Date of Patent: Jun. 27, 1989

[54] MOORING SYSTEM

[76] Inventor: Robert W. Brewerton, 4 Courtwood Drive, Sevenoaks, Kent, England

[21] Appl. No.: 88,672

[22] Filed: Aug. 24, 1987

[30] Foreign Application Priority Data

Aug. 27, 1986 [GB] United Kingdom ..... 8620694
Apr. 24, 1987 [GB] United Kingdom ..... 8709721

[51] Int. Cl.[4] ..... B63B 21/52
[52] U.S. Cl. ..... 114/230; 166/355
[58] Field of Search ..... 114/179, 230; 441/3–5; 166/355

[56] References Cited

U.S. PATENT DOCUMENTS

| | | | |
|---|---|---|---|
| 2,546,862 | 3/1951 | Marinch | 114/179 |
| 3,366,982 | 2/1968 | Sutton | 441/5 |
| 4,064,822 | 12/1977 | Thornburg | 114/230 |
| 4,604,961 | 8/1986 | Ortloff et al. | 441/5 X |
| 4,606,727 | 8/1986 | Koenig et al. | 441/5 |

*Primary Examiner*—Sherman D. Basinger

*Attorney, Agent, or Firm*—Wolf, Greenfield & Sacks

[57] ABSTRACT

A single point mooring system e.g. for an offshore oil or gas production system, consists of a rotary turret 6 provided in a floating structure 1 e.g. a tanker to which the turret is retrofitted. The turret 6 comprises a skirt portion 11 on the underside of the tanker and an upwardly extending cylindrical chimney portion 12. The turret is connected to the seabed by mooring lines 3 and risers 6 supply oil to the tanker for temporary storage. The mooring lines 3 comprise segmented chains that are hauled by winches 20 and secured by stoppers 18, 19 in the skirt 11. The turret is rotatably suspended from the upper end of the chimney portion 12 by an upper main bearing comprising rotary rings 40, 41, which is interchangeable whilst the mooring system is in service. Annularly disposed lower bearings 26 are arranged to resist radial loads on the chimney portion but to be compliant to axial turret loads, to accommodate forces and moments applied to the turret and the tanker by wave action.

22 Claims, 7 Drawing Sheets

MOORING SYSTEM

FIELD OF THE INVENTION

This invention relates to a mooring system and more particularly to a single point mooring system which has particular but not exclusive application to an off-shore hydrocarbon production facility.

BACKGROUND TO THE INVENTION

It has previously been proposed to utilise a tanker as an off-shore oil production platform. The tanker is provided with a turret having a generally cylindrical body extending vertically through the hull which acts as a pivot about which the ship can weathervane. The turret is moored by a number of mooring lines known as cateneries which extend to the seabed to prevent turret rotation. Oil production risers extend from a well head on the seabed into the turret and the output from the risers is fed into tanks in the ship for temporary storage. An arrangement of this kind is shown in GB No. 2 150 517 in which a rotary turret is provided on its underside with an annular platform to which the cateneries are attached using an external winch hung over the stern of the ship. The turret is supported at its lower end by an annular bearing arrangement which comprises an annular track around the turret and bearing members mounted on the hull of the ship which fit slidably in the track. The top end of the bearing is supported by another, upper annular bearing.

A difficulty with this bearing arrangement is that it cannot accommodate readily the stresses that occur on the turret when the ship is moored. It will be appreciated that the weight of the moorings, turret and heaving of the ship, particularly in heavy seas, produces substantial loads between the turret and the hull. Axial loads are accommodated primarily by the lower bearing, but the axial loading produces bearing wear. Also, axial loading produces a shear stress on the lower bearing's members that are attached to the hull. The upper bearing is not designed to accommodate substantial axial loading. Further, interchange of the upper bearing cannot be readily facilitated.

SUMMARY OF THE INVENTION

An object of the invention is to provide an improved bearing arrangement which can reliably accommodate the severe loads applied to the turret and which can be interchanged if necessary.

Another object of the invention is to provide an improved means for handling the mooring lines.

Broadly, the invention provides a mooring system comprising a floating structure, a rotary turrent, a plurality of mooring lines for extending from the bed of a body of water to the turret, the turret including a base portion on the underside of the floating structure and an elongate chimney portion extending upwardly from the base portion into the floating structure, hauling means for the mooring lines, means for securing the mooring lines to the base portion, upper main bearing means from which the chimney portion is rotatably suspended, and lower bearing means disposed around the lower periphery of the chimney portion, said lower bearing means being, in response to loading of the turret, relatively resistant to movement of the chimney portion transversely of its longitudinal axis and relatively compliant to axial movements of the chimney portion.

The floating structure can conveniently be a tanker with the turret retrofitted thereto. It is not necessary to provide individual hauling means for each of the mooring lines but advantageously three such hauling means equispaced about the perimeter greatly facilitates initial mooring up of the vessel.

Conveniently, the mooring lines comprise segmented chains which are secured to the turret by means of respective stoppers, advantageously of the type used in CALM (Catenery Anchor Leg Mooring) buoys. Conveniently, the hauling means comprises a winch or gypsy mounted in the tanker. In use, the gypsy hauls in the chain. The stopper is then inserted so as to locate the chain in the turret and appropriate segmental joint of the chain is released. Appropriate chain lockers are provided for the free ends of the chains. After release, the turret is then free to rotate.

The present invention also preferably includes an improved means for providing access to the region in which the lines are secured to the turret, and in one embodiment means are provided for pumping air into a space between the base portion and the floating structure to provide access for operators to the securing means. This arrangement thus provides access to the securing means even though said means may be below the water line.

In one embodiment, the base portion is received in a recess in the underside of the floating structure such that the periphery of the base portion and the recess are of such a close fit as to throttle ingress of water into the space between the base portion and the floating structure, thereby to inhibit changes of pressure and water level in the region of said mooring line securing means. This arrangement is of particular utility when it is desirable to access the chain stopper and lower bearing means internally in rough seas.

However, the turret may alternatively be mounted in the bow or stern of the tanker; in accordance with another preferred feature of the invention, access to the mooring line securing means may be achieved by altering the ballast of the tanker to cause the bow or stern to be tipped up above the water line.

Preferably, the upper main bearing comprises bearing rings rotatably mounted upon one another and respectively attached to the chimney portion and the floating structure. Preferably, means are provided to permit interchange of the upper main bearing, said means comprising means for jacking up the turret to release load from the annular bearing, and means for providing a temporary bearing for permitting removal of the annular bearing.

Towards the lower end of the chimney portion, the turret may be rotatably supported by a bearing comprising a plurality of bearing wheels rotatably mounted in an annular configuration on the floating structure around the chimney portion, said bearing wheels being received in respective resilient mountings which permit relatively small wheel movement radially of the turret but relatively large wheel movement axially thereof. In use, the chimney portion is subjected to substantial moments about the upper main bearing and transverse to the chimney axis. The plurality of annular bearing wheels acting in conjunction with the upper bearing thus resist these moments. Additionally, the chimney portion is subjected to substantial compression and extension forces which are accommodated by the resilient mountings of the bearing wheels.

Preferably, the bearing wheels are mounted on shafts that are received in supports comprising laminations of steel and elastomeric material extending longitudinally of the chimney axis.

The mooring system according to the invention thus has particular application to offshore oil or gas production facilities in which a plurality of risers extend from a well head on the seabed into the turret and are terminated at the upper end thereof.

The risers may each terminate at the bottom end of the turret at an appropriate termination joint and output from the risers may be conveyed by piping to the upper end of the turret. Preferably the risers are connected to the turret by means permitting rocking movement of the risers relative to the turret. The riser may be supported on the aforesaid base portion of the turret by means of a riser termination hanger, a hose bend resistor or alternatively, a ball joint may be utilised.

BRIEF DESCRIPTION OF DRAWINGS

In order that the invention may be more fully understood embodiments thereof will now be described by way of example with reference to the accompanying drawings in which.

DESCRIPTION OF PREFERRED EMBODIMENTS

Figure 1:
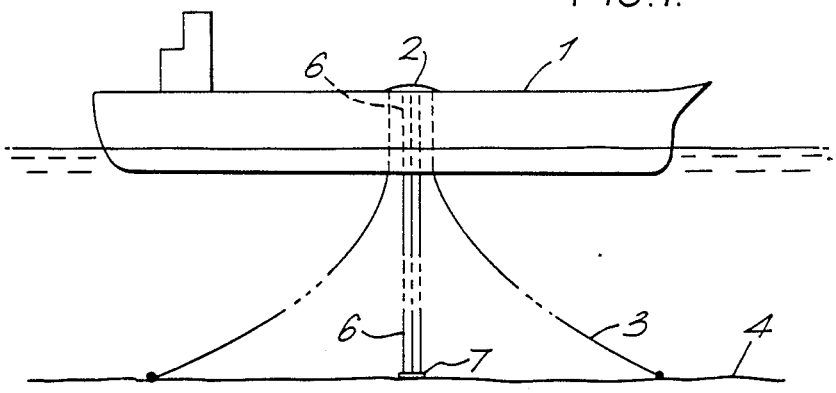
FIG. 1 is a schematic elevational view of a ship moored by single point mooring system.
Figure 2:
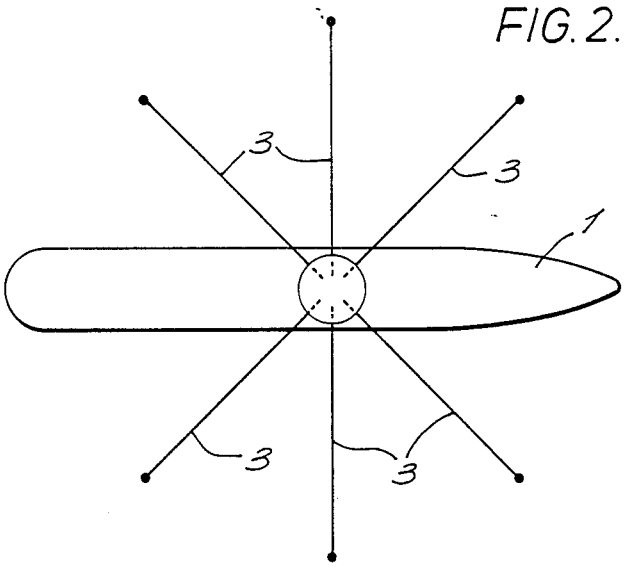
FIG. 2 is a schematic plan view of the system shown in FIG. 1.

FIGS. 1 and 2 show schematically a single point mooring system. A tanker 1 is provided midships with a rotary turret 2 that is held against rotation by means of six cateneries 3 anchored to seabed 4. Production risers 6 extend from a well head 7 on the seabed 4 into the turret 2. Oil from the risers 6 is transferred into the tanker for temporary storage and is subsequently offloaded to tankers which draw alongside or moor to the stern of the tanker 1.

Figure 3:
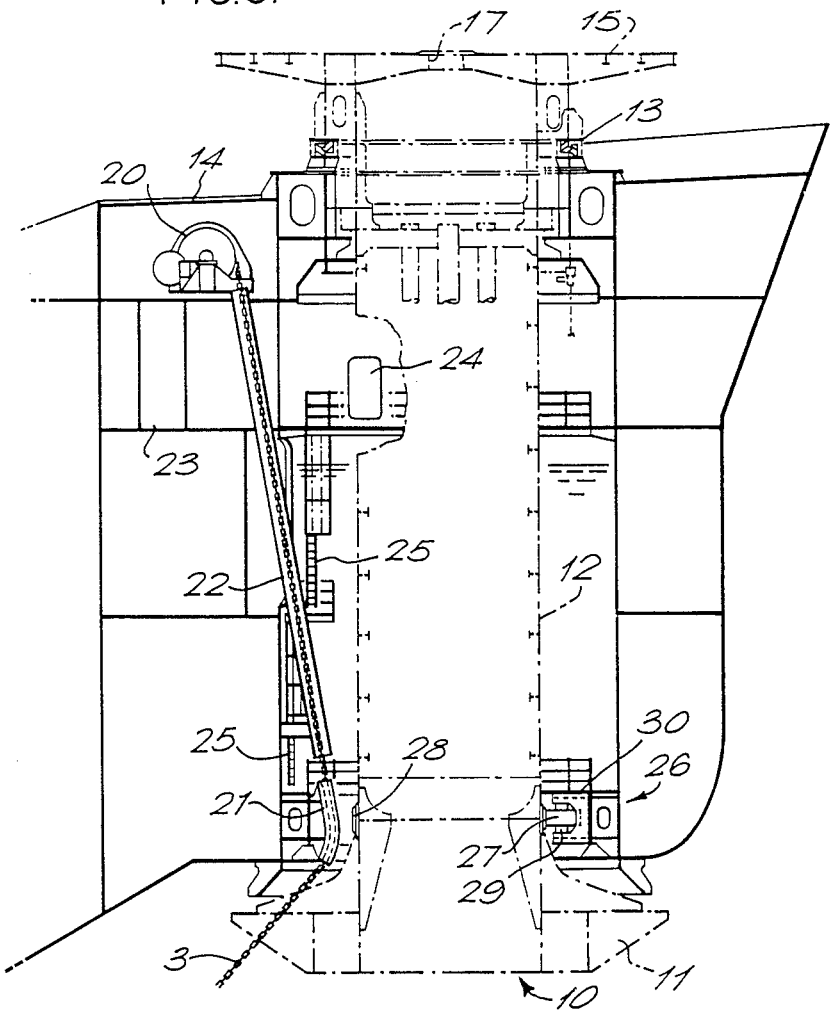
FIG. 3 is a schematic sectional view of a mooring system according to the invention in the bow of a tanker, showing the tanker in detail.
Figure 4:
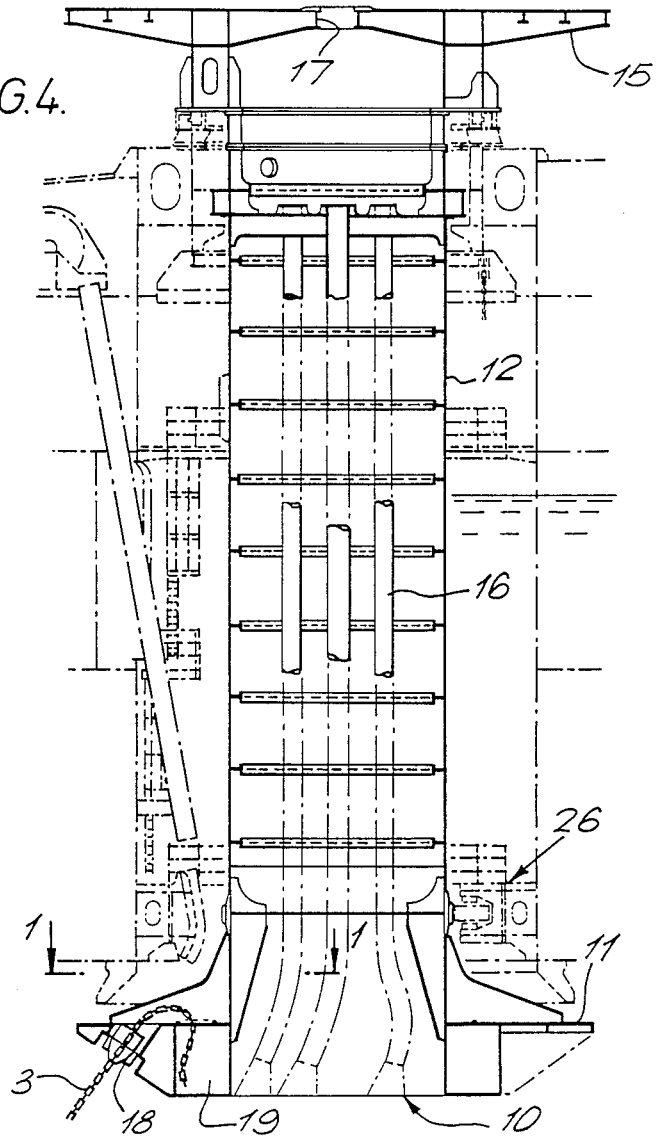
FIG. 4 is a view corresponding to FIG. 3, showing the turret in detail.

Referring now to FIGS. 3 and 4, these show an example of a mooring system according to the invention mounted in the bow of a tanker. FIG. 3 shows the bow in section with the turret shown in hatched outline whereas FIG. 4 shows the turret in more detail, with the turret shown in hatched outline.

The turret consists of a base portion 10 formed with an annular skirt 11, from which rises a cylindrical chimney portion 12 above the water line and is suspended from an upper main annular bearing 13 on upper deck 14 of the tanker. The turret also includes a turntable 15 mounted above the bearing 13.

As can be seen from FIG. 4, guide tubes 16 extend longitudinally of the turret so as to guide the risers 6 (FIG. 1) to the top end of the chimney portion 12. Appropriate riser terminations (not shown) are provided at the top end of the chimney portion so as to transfer oil from the risers into processing equipment on or into tanks in the ship, access and control of these terminations being achieved through an aperture 17 in the turntable 15.

Figure 5:
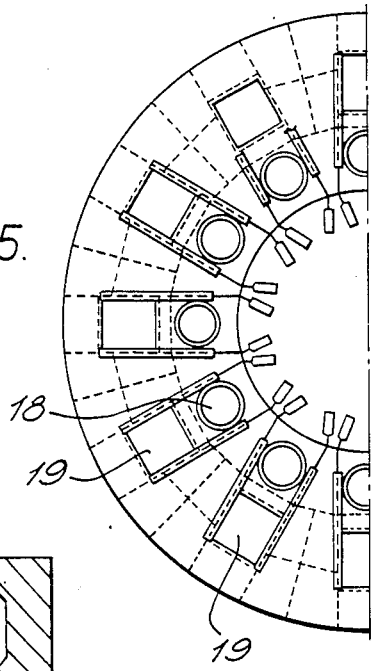
FIG. 5 is a partial section taken along the line 1—1 of FIG. 4.

In use, the turret is moored by several mooring chains 3 which extend through respective stoppers 18 that are spaced around the skirt 11 on the base portion 10. One of the stoppers 18 can be seen schematically in FIG. 4 and the radial disposition of the stoppers can be seen from FIG. 5. A chain locker 19 is provided pivotally in the skirt 11 for each stopper 18. Each stopper 18 consists of a conical seat mounted in the skirt 11 into which fits a conical plug that is manually fitted around a link of the chain 3 and acts as a clamping member. Such a stopper is well known per se in the art and thus will not be described further. Stoppers of this kind are used on CALM buoy. The chain 3 is segmented and has releasable links located at suitable intervals.

As can be seen from FIG. 3, a powered gypsy 20 is provided for hauling in the mooring lines 3. The gypsy 20 is mounted on a tween deck of the ship exteriorly of the turret. Advantageously, 3 gypsies are provided around the perimeter of the turret 2; it is not necessary to provide one gypsy 20 for each of the mooring lines 3. Each gypsy 20 has associated therewith a chain guide 21 and a guide pipe 22. A chain locker 23 is provided beneath each gypsy 20.

Access to the skirt 11 on the turret 2 is provided from the ship by means of an access doorway 24 which leads to an access ladderway 25, or alternatively by means of a powered hoist.

In order to adjust the mooring lines 3, the ship is turned about the turret so as to align a particular stopper 18 with an appropriate chain guide 21. The stern of the ship is then anchored to prevent further weathervaneing. Appropriate ballast is then pumped into the stern of the ship so as to lift the skirt 11 above the water line. The access doorway 24 is then opened and an operative climbs down the ladderway 25 or travels by hoist onto the skirt 11. The free end of the chain 3 which is stored in locker 19, is then connected to a length of chain lowered from the gyspy 20 through the guide pipe 22 and chain guide 21. The gypsy 20 is then operated to take up the slack. As a result, the conical plug of the stopper is removed from its seat and can be manually removed from the chain. Thereafter, the gypsy 20 can be used to draw in or pay out the chain and further chain lengths can be attached or removed from the line 3 using the previously described releasable links.

When the adjustment of the mooring lines is completed, the chain 3 is fixed in the stopper 18 with a plug as aforesaid and the next releasable link above the stopper is lowered by means of the gypsy to the top surface of the skirt 11 and then disconnected. The chain leg hanging from the gypsy is then wound up away from the skirt 11 and lower bearing of the turret. The free end of the chain is thus stowed in the chain locker 19. The bow of the ship is then again lowered into the water and the stern anchor released.

It will be appreciated that the effect of wave action on the ship will produce substantial stresses on the turret. The mooring lines 3, which are secured to the skirt of the turret introduce into-the structure forces which produce axial extension and contraction of the chimney portion 12 and which also produce forces transverse to the longitudinal axis of the turret thereby producing bending moments.

A lower, annular bearing arrangement 26 acting in conjection with the upper bearing 13 accommodates these bending moments. Bearing 26 consists of an annularly disposed series of bearing wheels 27 that engage a wheel rail 28 disposed on the exterior periphery of the chimney portion 12 of the turret. Each bearing wheel 27 is received on a respective shaft 29 mounted in a yoke 30. This arrangement is shown in more detail in FIG. 6. Each end of the shaft 29 is held by a key 31 on a respective support plate 32 of a generally triangular configuration. The yoke 30 consists of two parts 30*a*, 30*b*, bolted together by bolts 33. The triangular supports 32 are surrounded by a laminated arrangement of steel plates and elastomeric layers 34 which are held in compression by the bolts 33.

In use, the chimney portion 12 of the turret tends to extend and contract longtudinally as a result of stresses applied thereto by wave action and the cateneries 3. The bearing arrangement shown in FIG. 6 needs to be able to accommodate such movement. The packing 34 permits the shaft 29 and associated supports 32 to slide axially so as to accommodate the axial movement of the turret. In contrast, the packing 34 does not permit substantial movement in a direction radially of the turret and thus the bearing is able to withstand bending moments applied to the turret 2.

Figure 7:
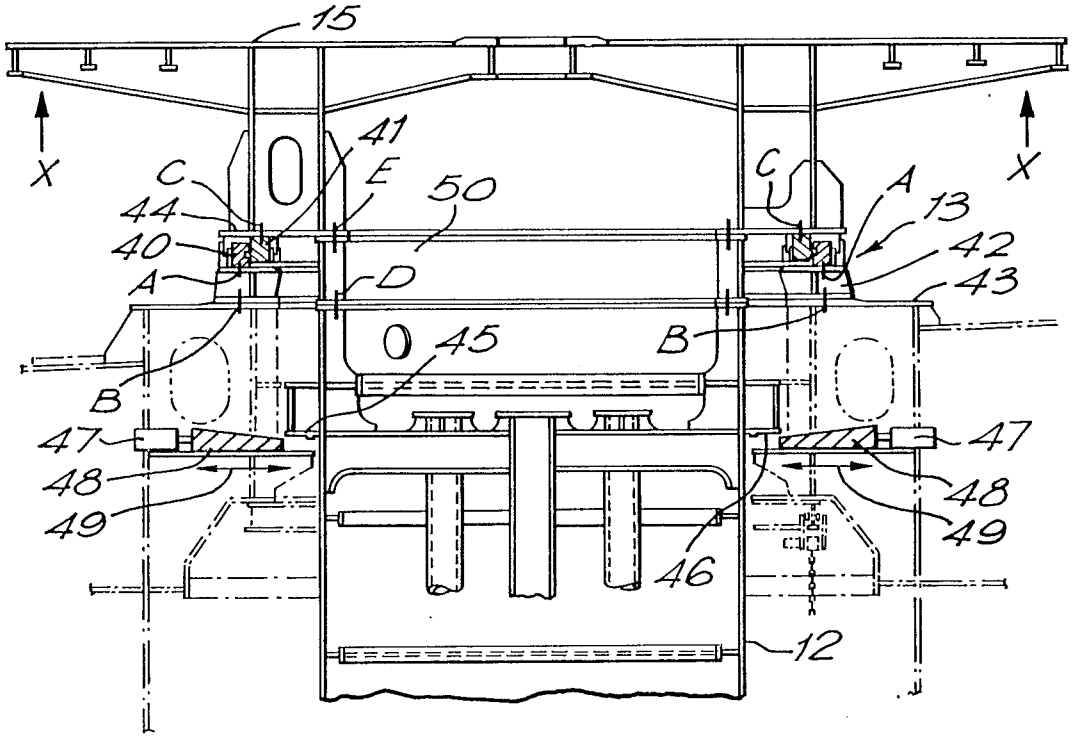
FIG. 7 is a vertical section of the turret for explaining interchange of the bearing 13.

As previously mentioned, the upper annular bearing 13 is interchangeable and the method of interchange will now be described in detail with reference to FIG. 7. The annular bearing 13 consists of first and second machined rings 40, 41 rotatably coupled to one another by roller bearings (not shown). The rings 40, 41 are pressed against one another as a result of the chimney portion 12 effectively being suspended from the ring 41. The ring 40 is attached by bolts A to a circular stool 42 itself attached by bolts B to the upper deck 43 of the ship.

The bearing ring 41 is attached by bolts C to a circular base plate 44 which forms the base of the turntable 15.

Referring now to the chimney portion 12 of the turret, this includes a transverse circular plate 45 which is machined around its exterior periphery to provide a bearing surface 46. Hydraulic jacks 47 or other means are arranged to drive bearing pads 48 in the direction of arrows 49 to engage the bearing surface 46. At the top of the chimney portion 12 of the turret, there is provided a detachable chimney piece 50 secured by a ring of bolts D to the chimney 12 and also by a ring of bolts E to the base plate 44 of the turntable 15. Jacks (not shown) are provided for lifting the turntable 15 in the direction of the arrows X—X.

In order to change the bearing 13, the ship is first anchored to prevent rotation relative to the turret 2 and the turret is locked in position. Then the bolts B are removed and the turntable 15 is jacked upwardly at X—X in order to lift the entire turret 2 and the turntable slightly upwardly relative to the ship. The jacks 47 are then actuated to drive the bearing pads 48 inwardly underneath the bearing surface 46, to provide a temporary bearing during interchange of the main bearing 13. The turntable 15 is then lowered to engage the bearing surface 46 on the bearing pads 48. The bolts C, D and E are then removed and the entire assembly of the chimney piece 50, the bearing rings 40, 41 and the stool 42 can then be slid out transversely upon further jacking up of the turntable 15 at the points X—X.

The bearing arrangement 13 with new rings 40, 41 can then be reinserted and reconnected in a reverse order to that described above.

Figure 8:
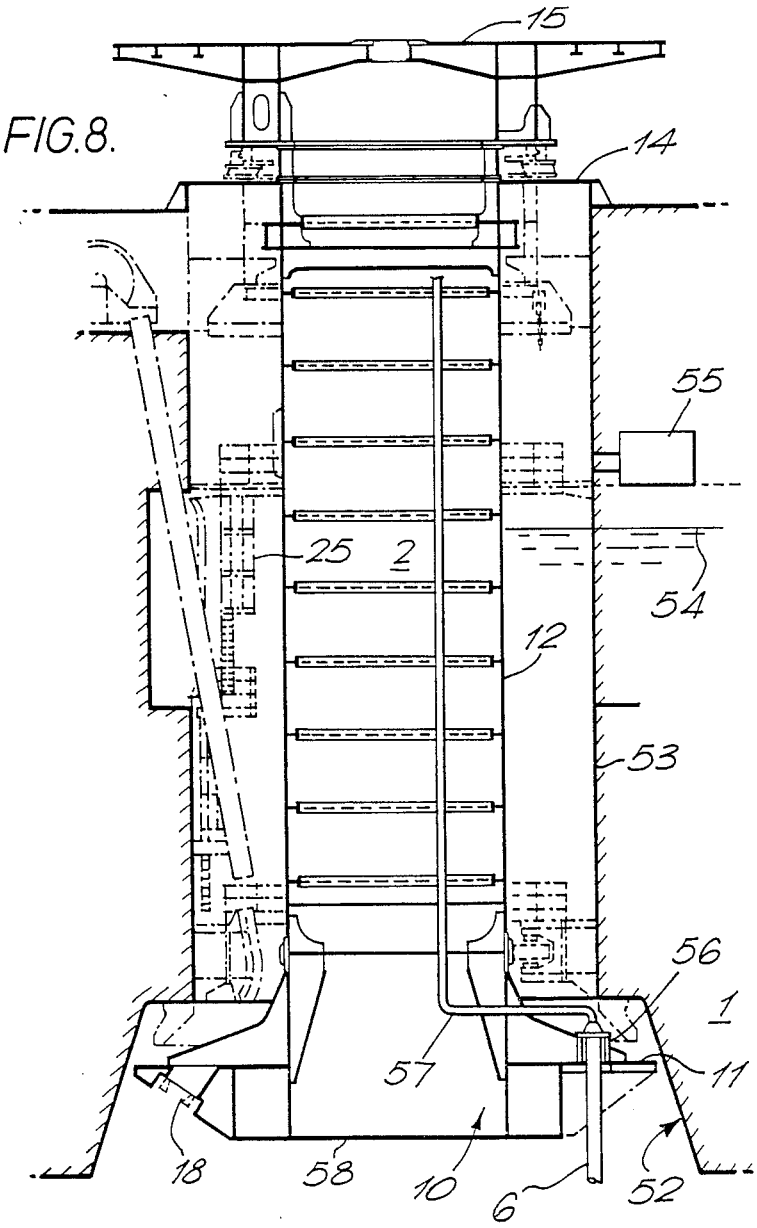
FIG. 8 is a vertical section of a turret mounted midships.

In the arrangement described in relation to FIGS. 3 to 7, the turret 2 is mounted in the bow of the ship. It will be appreciated however that the turret could also be mounted in he stern or midships. When mounted midships, it is not possible to tilt the ship to lift the base portion 10 of the turret 2 above the water line. The arrangement shown in FIG. 8 provides a solution to this problem. The turret 2 is mounted midships. The base portion 10 of the turret has the exterior periphery of its skirt 11 in close proximity to the edge of an annular recess 52 in the underside of the hull of the ship 1. The turret 2 which is of a substantially similar construction to that previously described, is received within the generally tubular airtight housing 53 extending vertically through the ship. The housing 53 includes the areas that receive the gypsies 20 and the chain lockers 23. The top end of the housing 53 is arranged to provide a rotary airtight seal onto the chimney portion 12 of the turret. A pump 55 is arranged to pump air under pressure into the chamber 53. The normal water line of the ship is shown at 54.

Thus in use, the increase in pressure in the chamber 53 forces the water level below the normal water line, to the level of the base portion 10 of the turret. This enables manual operators to descend the access ladderway 25 or by hoist (not shown) and work on the chains at the level of the annular skirt 11.

Since the external periphery of the skirt 11 is in close proximity to the edge of the annular recess 52, a throttling effect occurs for changes in water pressure produced by wave action. Thus, the rise and fall of water within the recess 52 is substantially reduced. Also, during those times when the well is pressurised with air to lower he water level, changes in air pressure resulting from the changes in water level are reduced also thus making it safe for operators to work on the skirt 11.

FIG. 8 also illustrates an alternative means by which the risers 6 may be connected to the turret. When a large number of risers are to be fed into the turret, a space problem can arise which is overcome by the configuration shown in FIG. 8. The risers 6 are terminated adjacent to the skirt 11 by a plurality of terminations 55 which are disposed between adjacent stoppers 18. One of the risers 6 is shown in FIG. 8 and is supported at its uppermost end above the water line occuring in recess 52 (when pump 55 is operational), the riser 6 being supported by a hanger 56. The riser 6 is connected to fixed piping 57 provided in the turret which extends upwardly towards the upper deck 14. In an alternative arrangement the hanger 56 can be replaced by a ball joint (not shown), or the hose end can be provided with a bend restrictor.

Another advantage of this arrangement is that the lifting means for adjustment of the chains can also be used for heaving in to the turret or lowering the risers, thus removing the need for riser handling equipment on the turret.

Since the pipes 57 are of reduced diameter compared with the guide 16 shown in FIG. 4, more risers can be accommodated. Also, the arrangement permits the lowermost end 58 of the turret to be closed thus reducing further the effects of water pressure fluctuations within the chamber 53.

Figure 9:
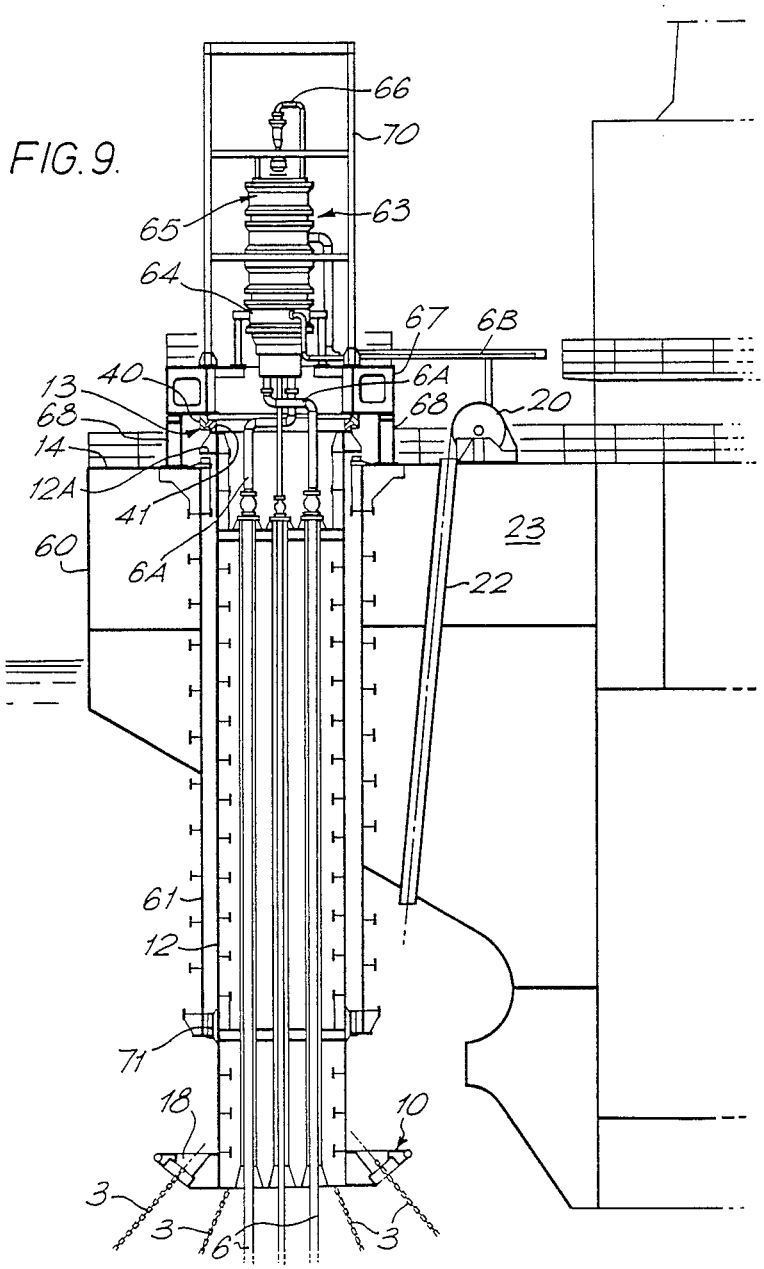
FIG. 9 is a vertical section of a turret mounted in the stern.

FIG. 9 shows an example of the turret mounted in the stern 60 of the tanker and has its chimney portion 12 rotatably mounted in an outer tube 61 that is fixed in the stern of the hull e.g. by retro-fitting. The chimney portion 12 is suspended from an annular main bearing 13 but it is to be noted that no turntable 15 is provided as in FIG. 3. The bearing 13 of FIG. 9 may be interchanged in the manner generally described in detail with reference to FIG. 7, but in which a temporary bearing support (not shown) is provided under flanges 12A on the upper end of the chimney portion, the bearing rings 40, 41 is removed and replaced and the turret is then jacked up with jacks (not shown) to allow the new bearing rings 40, 41 to be bolted in place.

As in FIG. 3, the risers 6 are received within guide tubes 16 within the turret. In FIG. 3, the risers 7 are connected to deck equipment (not shown) which is provided on the turntable 15. The arrangment shown in FIG. 9 provides a modification in which the equipment is mounted on the upper deck 14 of the ship and is connected to the risers through a swivel arrangement mounted above the chimney portion 12. The swivel arrangement is shown generally at 63 and includes an electric swivel 64 that provides a connection between riser extensions 6A and lines 6B connected to process plant (not shown) mounted on the deck 14. The swivel arrangement 63 also includes a toroidal swivel stack 65 and coaxial gas swivels 66 which permit connections to be made between the risers and the deck mounted process plant.

The bearing 13 comprises fixed and rotary rings 40, 41 fixed ring 40 being mounted on a box sectioned support 67 mounted on a annular arrangement of columns 68 that is upstanding from the deck 14. The rotary ring 41 of bearing 13 is mounted on the upper end of the chimney portion 12 of the turret. In contrast to the arrangement of FIG. 3 and 7, the rings 40, 41 are subject to a force that tends to separate them due to the direct suspension from box 67, whereas in FIGS. 3 and 7 the rings ae subject to a compressive force. The swivel arrangement 63 is mounted in an open frame 70 that extends upwardly from the support 67.

If desired, walls can be provided spanning the spaces between the columns 68 and the spaces between the members of the frame 70, to provide an enclosed space for operators to work on the riser extensions 6A and the swivel 63. The enclosed space may be provided with appropriate ventilation.

Figure 6A:
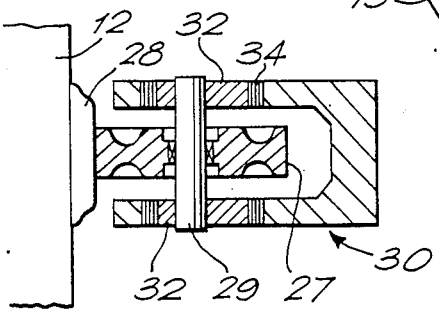
FIG. 6A is a detailed vertical section of the bearing wheel arrangement 27 shown in FIG. 3.
Figure 6B:
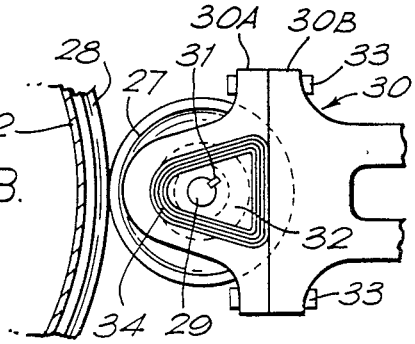
FIG. 6B is a plan view of the arrangement shown in FIG. 6A.

Bearing 13 takes up vertical forces applied to the turret; horizontal forces are accommodated by bearing 13 and segmented plain bearings 71 at the bottom of the tube 61. The plain bearings 71 consist of a machined bearing surface on the exterior of the turret and annularly disposed bearing pads of suitable frictional and wear properties. The pads permit rotational movement of the turret but resist radial movement. The plain bearing also permits axial extension and contraction of the chimney portion 12. Alternatively the bearings 71 can be as shown in FIG. 6.

Mooring is achieved by means of the sectioned chains 3 which extend through stoppers 18 in the annular skirt 11. The chains are hauled in by means of at least one gipsy 20 and an associated guide tube 22, in the manner previously explained.

The arrangement shown in FIG. 9 has the advantage of providing a chimney portion which is of reduced diameter compared with previously proposed arrangements. The turret arrangement can be readily fitted into an existing tanker by removal of the rudder and insertion of the tube 61 in the region where the rudder is conventionally housed.

With tankers, the stern is connventionally a relatively strong part of the structure as a result of which it may be possible to mount the tube 61 and the turret 10, 11, 12 on an external structure welded on to the exterior of the ship at the stern.

I claim:

1. A mooring system comprising, a floating structure, a rotary turret, a plurality of mooring lines for extending from the bed of a body of water to the turret, the turret including a base portion on the underside of the floating structure and an elongated chimney portion extending upwardly from the base portion into the floating structure, hauling means for the mooring lines, means for securing the mooring lines to the base portion, upper main bearing means from which the chimney portion is rotatably suspended, and lower bearing means around the lower periphery of the chimney portion, said lower bearing means being, in response to loading of the turret, relatively resistant to movement of the chimney portion transversely of its longitudinal axis and relatively compliant to axial movements of the chimney portion, said chimney portion being generally cylindrical and said base portion having a skirt around the periphery of the lower end of the chimney portion, said mooring lines comprising segmented chains, and said securing means comprising releasable chain stoppers disposed around said skirt, chain guide means on the floating structure and extending upwardly from adjacent said skirt, said hauling means being disposed on the floating structure for hauling chain through said chain guide means, both said chain guide means and said hauling means disposed in said floating structure adjacent but independently supported from said rotary turret.

2. A mooring system according to claim 1 including a chain locker adjacent said hauling means and a chain locker adjacent said stopper means.

3. A mooring system according to claim 2 wherein, after the hauling means is operated and the stopper means is installed, the segmented chain is separated so as to enable rotation of the floating structure relative to the turret.

4. A mooring system according to claim 1 including a given number of said mooring lines and a smaller number of said hauling means.

5. A mooring system according to claim 4 including means for producing a relative displacement of the base portion and the waterline such as to bring the base portion above the waterline.

6. A mooring system according to claim 5 wherein said displacement producing means comprises means for tilting the floating structure.

7. A mooring system according to claim 5 wherein said displacement means comprises means for pumping air into an enclosed space between the base portion and the floating structure to provide access for operators to the mooring line securing means.

8. A mooring system comprising a floating structure, a rotary turret, a plurality of mooring lines for extending from the bed of a body of water to the turret, the turret including a base portion on the underside of the floating structure and an elongate chimney portion extending upwardly from the base portion into the floating structure, hauling means for the mooring lines, means for securing the mooring lines to the base portion, upper main bearing means from which the chimney portion is rotatably suspended, and lower bearing means disposed around the lower periphery of the chimney portion, said lower bearing means being, in response to loading of the turret, relatively resistant to movement of the chimney portion transversely of its longitudinal axis and relatively compliant to axial movements of the chimney portion, said chimney portion is generally cylindrical and said base portion provides an annular skirt around the periphery of the lower end of the chimney portion, said mooring lines comprise segmented chains, and said securing means comprise releasable Chain stoppers disposed around said annular skirt, chain guide means on the floating structure and extending upwardly from adjacent said skirt, said hauling means being disposed on the floating structure for hauling chain through said chain guide means, and a chain locker to receive chain from the hauling means, including a given number of said mooring lines and a smaller number of said hauling means, means for producing a relative displacement of the base portion and the water line such as to bring the base portion above the water line, said displacement means comprising means for pumping air into an enclosed space between the base portion and the floating structure to provide access for operators to the mooring line securing means, the base portion being received in a recess on the underside of the floating structure such that the periphery of the base portion and the recess are of such a close fit as to throttle ingress of water into the space between the base portion and the floating structure, whereby to inhibit changes in air pressure and water level in the region between the chimney portion and the floating structure.

9. A mooring system according to claim 8 wherein said upper main bearing means includes first and second rings rotatably mounted upon one another and attached to the chimney portion of the turret and the floating structure respectively, said upper main bearing means being interchangeable whilst the mooring system is in service.

10. A mooring system according to claim 9 and including, to interchange the main bearing, means for jacking up the turret to release load from the main bearing, and means for providing a temporary bearing for permitting removal of the main bearing.

11. A mooring system according to claim 10 wherein said lower bearing comprises a plurality of bearing wheels rotatably mounted in an annular configuration on the floating structure around the chimney portion, and resilient mountings for the bearing wheels respectively, the resilient mountings permitting relatively small wheel movement radially of the chimney portion but relatively large wheel movement axially of the chimney portion.

12. A mooring system according to claim 11 wherein said bearing wheels are mounted on shafts, and said resilient mountings include supports for the shafts that include laminations of relatively rigid and relatively resilient material, said laminations extending longitudinally of the axis of the chimney portion.

13. A mooring system according to claim 1 wherein said lower bearing includes a plain bearing.

14. A mooring system according to claim 13 for use in offshore oil or gas production wherein said floating structure comprises a storage vessel for oil or gas, and including a plurality of risers extending from a well head on the seabed into the turret.

15. A mooring system according to claim 14 wherein the risers terminate in the upper end of said chimney portion.

16. A mooring system according to claim 14 wherein the risers terminate at the lower end of the turret, and including for at least one riser a riser termination that permits rocking movement of the riser relative to the turret.

17. A mooring system according to claim 14 including a turntable mounted on the turret for rotation therewith and equipment mounted on the turntable for connection to the risers.

18. A mooring system according to claim 14 including equipment mounted on a deck of the floating structure, and a swivel mounted above the upper end of the chimney portion on the floating structure and arranged to connect the equipment to the risers.

19. A mooring system according to claim 18 wherein said hauling means are arranged for handling the risers.

20. A mooring system according to claim 19 including three said hauling means.

21. A mooring system comprising a floating structure, a rotary turret including a chimney portion extending upwardly into the floating structure from the underside thereof, and a base portion including a skirt around the periphery of the lower end of the chimney portion, a plurality of segmented mooring chains for extending from the bed of a body of water to the skirt, hauling means on the floating structure for hauling the mooring chains;

guide means on the floating structure for guiding the mooring chains from the skirt to the hauling means, releasable chain stoppers for securing the mooring chains to the skirt, upper main bearing means from which the chimney portion is rotatably suspended, lower bearing means disposed around the lower periphery of the chimney portion, and lower main bearing means being in response to loading of the turret, relatively resistant to movement of the chimney portion transversely of its longitudinal axis and relatively compliant to axial movements of the chimney portion, one of the chains being connected such that it extends from the skirt through the guide means to the hauling means, means for operating the hauling means, said stopper securing the mooring chain to the skirt, the segmented mooring chain being disconnected between the guide means and the skirt so as to permit rotation of the floating structure relative to the turret.

22. A method of mooring a floating structure provided with a rotary turret that comprises a chimney portion extending upwardly into the floating structure from the underside thereof and a skirt around the periphery of the lower end of the chimney portion, a plurality of segmented mooring chains extending form the bed of a body of water to the skirt, chain stoppers for securing the chains to the skirt, hauling means on the floating structure for hauling the chains, guide means on the floating structure for guiding the chains from the skirt to the hauling means, upper main bearing means from which the chimney portion is rotatably suspended, and lower bearing means disposed around the lower periphery of the chimney portion, the method comprising the steps of (i) connecting one of the chains such that it extends from the skirt through the guide means to the hauling means, (ii) operating said hauling means, (iii) securing the chain to the skirt with a said chain stopper, and (iv) disconnecting the segmented chain line between the guide means and the skirt whereby to permit rotation of the floating structure relative to the turret.

* * * * *